US011291244B2

(12) United States Patent
Rojo-Calderon et al.

(10) Patent No.: US 11,291,244 B2
(45) Date of Patent: Apr. 5, 2022

(54) END PIECE FOR AEROSOL GENERATING ARTICLE

(71) Applicant: PHILIP MORRIS PRODUCTS S.A., Neuchâtel (CH)

(72) Inventors: Noelia Rojo-Calderon, Neuchâtel (CH); Rui Nuno Batista, Morges (CH)

(73) Assignee: Philip Morris Products S.A., Neuchâtel (CH)

( * ) Notice: Subject to any disclaimer, the term of this patent is extended or adjusted under 35 U.S.C. 154(b) by 49 days.

(21) Appl. No.: 16/066,447

(22) PCT Filed: Dec. 6, 2016

(86) PCT No.: PCT/IB2016/057390

§ 371 (c)(1),
(2) Date: Jun. 27, 2018

(87) PCT Pub. No.: WO2017/115181

PCT Pub. Date: Jul. 6, 2017

(65) Prior Publication Data

US 2019/0000141 A1 Jan. 3, 2019

(30) Foreign Application Priority Data

Dec. 29, 2015 (EP) ..... 15202949

(51) Int. Cl.
*A24F 13/02* (2006.01)
*A24F 13/14* (2006.01)
(Continued)

(52) U.S. Cl.
CPC ..... *A24F 13/02* (2013.01); *A24F 13/14* (2013.01); *A24F 42/10* (2020.01); *A24D 1/22* (2020.01)

(58) Field of Classification Search
CPC ..... A24F 13/14; A24F 13/16; A24F 13/02
See application file for complete search history.

(56) References Cited

U.S. PATENT DOCUMENTS 2,372,277 A 3/1945 Jackson
3,362,415 A 1/1968 Ellis
(Continued)

FOREIGN PATENT DOCUMENTS

BE 1008694 A6 7/1996
CN 104188108 A 12/2014
(Continued)

OTHER PUBLICATIONS

International Search Report and Written Opinion for PCT/IB2016/057390, issued by the European Patent Office as the International Search Authority, dated Mar. 29, 2017; 14 pgs.
(Continued)

*Primary Examiner* — Eric Yaary
*Assistant Examiner* — Jennifer A Kessie
(74) *Attorney, Agent, or Firm* — Mueting Raasch Group

(57) ABSTRACT

An end piece (200) for positioning over a heat source (102) of an aerosol generating article (100) includes a body (210) defining a bore configured to receive the aerosol generating article and includes a cage (220) configured to surround at least a portion of the heat source and to allow air to access the heat source. The end piece also includes a stop (240) arranged to engage a distal end (105) of the heat source as the aerosol generating article is slid through the bore. The stop is configured to prevent the distal end of the heat source from being advanced beyond the cage. The end piece may optionally include a seal (230) extending from an inner surface of the cage downstream of the stop. The seal is arranged to surround and contact the aerosol article to limit volatile compounds released from the heat source during combustion from entering air drawn through the aerosol generating article.

22 Claims, 3 Drawing Sheets

(51) Int. Cl.
*A24F 42/10* (2020.01)
*A24D 1/22* (2020.01)

(56) References Cited

U.S. PATENT DOCUMENTS

| | | | | | |
|---|---|---|---|---|---|
| 4,289,149 | A * | 9/1981 | Kyriakou | A24F 13/14 131/175 |
| 4,386,616 | A | 6/1983 | Rosen | |
| 4,570,645 | A * | 2/1986 | Newman, Sr | A24F 13/14 131/175 |
| 4,572,217 | A | 2/1986 | Newman, Sr. et al. | |
| 5,020,548 | A | 6/1991 | Farrier et al. | |
| 5,040,552 | A | 8/1991 | Schleich et al. | |
| 5,595,577 | A | 1/1997 | Bensalem et al. | |
| 6,006,757 | A * | 12/1999 | Lichtenberg | A24F 13/00 131/187 |
| 6,367,481 | B1 | 4/2002 | Nichols et al. | |
| 6,371,127 | B1 | 4/2002 | Snaidr et al. | |
| 7,600,517 | B1 | 10/2009 | Holzrichter | |
| 7,660,517 | B2 | 2/2010 | Garg et al. | |
| 2010/0258139 | A1 * | 10/2010 | Onishi | A24F 47/006 131/194 |
| 2015/0027458 | A1 | 1/2015 | Grant | |

FOREIGN PATENT DOCUMENTS

| | | | |
|---|---|---|---|
| FR | 2911761 | A1 | 8/2008 |
| JP | S59-154092 | U | 10/1984 |
| JP | H0440873 | U | 4/1992 |
| JP | H05-091392 | U | 12/1993 |
| JP | S63214173 | A | 9/1998 |
| JP | 2000-106862 | A | 4/2000 |
| JP | 2005-058179 | A | 3/2005 |
| JP | 5635483 | | 5/2013 |
| JP | 2015-509706 | A | 4/2015 |
| RU | 2180180 | C2 | 3/2002 |
| RU | 2002128754 | A | 4/2004 |
| WO | 056948 | | 7/2003 |
| WO | WO 2009/022232 | A2 | 2/2009 |
| WO | WO-2013076098 | A2 * | 5/2013 |

OTHER PUBLICATIONS

Russian Decision to Grant dated Jan. 29, 2020 by the Patent Office of the Russian Federation for corresponding application No. RU 2018123493; 15 pgs. including English Translation.

First Office Action issued for Chinese Application No. 201680071157.0, issued by the China National Intellectual Property Administration dated Jul. 3, 2020; 20 pgs. including English Translation.

Japanese Office Action issued for JP 2018-533792 by the Japanese Patent Office dated Jan. 28, 2021; 9 pgs. including English Translation.

Third Office Action for CN Application No. 201680071157.0 issued by the Chinese National Intellectual Property Administration dated Jun. 3, 2021; 8 pgs.

* cited by examiner

END PIECE FOR AEROSOL GENERATING ARTICLE

This application is the § 371 U.S. National Stage of International Application No. PCT/IB2016/057390, filed 6 Dec. 2016, which claims the benefit of European Application No. 15202949.2, filed 29 Dec. 2015.

This invention relates to an aerosol generating article having a combustible heat source for heating an aerosol generating substrate.

A number of smoking articles in which tobacco is heated rather than combusted have been proposed in the art. An aim of such 'heated' smoking articles is to reduce certain smoke constituents of the type produced by the combustion and pyrolytic degradation of tobacco in conventional cigarettes.

In one known type of heated smoking article, an aerosol is generated by the transfer of heat from a combustible heat source to a physically separate aerosol generating substrate, for example containing tobacco. The aerosol generating substrate may be located within, around or downstream of the combustible heat source. During use, volatile compounds are released from the aerosol generating substrate by heat transfer from the combustible heat source and entrained in air drawn through the smoking article. As the released compounds cool, they condense to form an aerosol that is inhaled by the user.

Aerosol generating articles, for example heated smoking articles, may be configured so that the combustible heat source is blind, which may limit the amount or number volatile compounds released from combustion of the heat source that enter air drawn through the smoking article. Heated smoking articles having blind combustible heat sources may transfer heat to the aerosol-generating substrate primarily via conduction. Heated smoking articles may also be configured so that the heat source is non-blind. Heated smoking articles having non-blind combustible heat sources transfer heat to the aerosol-generating substrate primarily via convection through one or more air flow channels through the heat source, which allow volatile compounds from the heat source to enter air drawn through the smoking article. Because one aim of heated smoking articles is to reduce certain smoke constituents produced via combustion, heated smoking articles employing blind heat sources may be preferred.

Published PCT patent application, WO-A2-2009/022232, discloses an example of a heated smoking article having a non-blind heat source. The heated smoking article disclosed in WO-A2-2009/022232 comprises a combustible heat source, an aerosol generating substrate downstream of the combustible heat source, and a heat conducting element around and in contact with a rear portion of the combustible heat source and an adjacent front portion of the aerosol generating substrate. An air flow channel extends through the heat source such that air may be drawn through the channel downstream towards a mouthpiece.

Regardless of whether aerosol generating articles include a blind or non-blind combustible heat source, the heat source may require direct contact with air to burn properly. Thus, aerosol generating articles may be manufactured such that the heat source is exposed to a user and their surroundings during use. However, temperatures of the combustible heat sources may be quite high when burning. For example, temperatures of the heat sources during combustion may be more than 600° C.

One object of examples of the invention is to reduce the temperature of an exposed element to which a user of an aerosol generating article having a combustible heat source or their environment may be exposed. Another object of examples of the invention is to maintain a blind heat source while reducing the temperature of an exposed element to which a user or their environment may be exposed.

In various aspects, the invention provides an end piece for positioning over a heat source of an aerosol generating article. The end piece comprises a body defining a bore configured to receive, for example slidably receive, the aerosol generating article. The end piece also comprises a cage configured to surround at least a portion of the heat source and to allow air to access the heat source. The end piece further comprises a stop arranged to engage a distal end of the heat source as the aerosol generating article is slid through the bore. The stop is configured to prevent the distal end of the heat source from being advanced beyond the cage. The end piece may optionally comprise a seal extending from an inner surface of the cage downstream of the stop. The seal is arranged to surround and contact the aerosol article and is configured to prevent or limit combustion products released from the heat source from entering air drawn through the aerosol generating article.

The term "aerosol generating article" refers to an article comprising an aerosol generating substrate that releases volatile compounds to form an aerosol that may be inhaled by a user. The term "aerosol-generating substrate" refers to a substrate capable of releasing, upon heating, volatile compounds, which may form an aerosol. The aerosols generated from aerosol-generating substrates of articles according to the invention may be visible or invisible and may include vapours (for example, fine particles of substances, which are in a gaseous state, that are ordinarily liquid or solid at room temperature) as well as gases and liquid droplets of condensed vapours.

The terms "distal," "upstream," "proximal," and "downstream" are used to describe the relative positions of components, or portions of components, of an aerosol generating article. Aerosol generating articles according to the invention have a proximal end through which, in use, an aerosol exits the article for delivery to a user, and have an opposing distal end. The proximal end of the aerosol generating article may also be referred to as the mouth end. In use, a user draws on the proximal end of the aerosol generating article in order to inhale an aerosol generated by the aerosol generating article. The terms upstream and downstream are relative to the direction of aerosol movement through the aerosol generating article when a user draws on the proximal end.

Various aspects of the aerosol generating articles and end pieces according to the present invention may have one or more advantages relative to currently available aerosol generating articles that include a combustible heat source. For example, end pieces according to the invention may provide a simple to use barrier to protect a smoker or their surrounding environment from contact with a combusted heat source having a high temperature. The cage of the end piece that surrounds the heat source may be separated from the heat source so that the temperature of the cage is lower than the temperature of the combusted heat source. The cage may also be configured to efficiently dissipate heat to reduce temperature of the cage relative to the combusted heat source. In some preferred embodiments, end pieces according to the invention are configured to prevent or reduce the number or amount volatile compounds released from the heat source during combustion from entering air drawn through the aerosol generating article and inhaled by a user. The end piece may include a seal extending from an inner surface of the cage and arranged to surround and seal the aerosol generating article between the heat source and, for example, the aerosol-generating substrate to limit volatile compounds released from the heat source during combustion from entering drawn through the aerosol generating article. Additional advantages of one or more aspects of aerosol generating articles described herein will be evident to those of skill in the art upon reading and understanding the present disclosure.

The present invention relates to an aerosol generating article having a combustible heat source for heating an aerosol generating substrate and an end piece for positioning over the heat source. The end piece includes a cage configured to surround at least a portion of the heat source and to allow air to access the heat source. In use, the temperature of the cage is substantially lower than the heat source during combustion. Accordingly, the temperature of an element to which a user of the aerosol generating article may be exposed is reduced.

The end piece includes a main body. The body defines a bore for slidably receiving an aerosol generating article having a combustible heat source. The bore defines an inner surface of the body. Preferably, at least a portion of the inner surface of the body engages the aerosol generating article when the article is received in the bore. For example, the inner surface of the body may define one or more detents that are configured to engage the aerosol generating article by interference fit. In addition or alternatively, the bore may be sized to engage the aerosol generating article along its length. Alternatively, one or more additional elements disposed in the bore may engage the aerosol generating article. Regardless of whether the inner surface of the body is configured to engage the aerosol generating article or whether an additional element in the bore is configured to engage the aerosol generating article, the aerosol generating article is preferably retained in a longitudinal position relative to the body in use. The aerosol generating article is preferably insertable or removable from the bore with minimal force. For example, the aerosol generating article may be readily inserted or withdrawn from the bore by a user.

The body may be formed of any suitable material or combination of materials. For example, the body may be formed from a material comprising a polymer, such as a thermoplastic polymer, or a material comprising a metal, such as aluminium or stainless steel, or a ceramic material. In addition or alternatively, the body may for example be formed of wood or a carbon fibre or glass fibre material. Examples of suitable polymer materials that may be used to form the body include polyetheretherketone (PEEK).

The cage and the body may be formed from a single part. Alternatively, the cage and body may be formed from separate parts. Preferably, the cage and body are formed from separate parts.

Preferably, the cage is slidably disposed about the body, allowing the end piece to have a more compact size when stored and an elongated size when in use. Preferably, the slidable cage and body are configured so that the cage is prevented from accidentally sliding off the body. For example, the body may comprise a distal flange that engages a proximal stop of, or attached to, the cage to prevent the cage from sliding distally off of the body. The body may also comprise, for example, a proximal flange that engages the proximal stop to prevent the cage from sliding proximally off the body.

The cage defines a bore having a longitudinal axis and an inner diameter greater than the outer diameter of the heat source of the aerosol generating article. In some examples, the bore diameter may be similar to that of the outer diameter of the aerosol generating article. The article may be held with a friction fit in the bore. A tapered opening or chamfer may be provided to facilitate insertion of the aerosol generating article. As used herein, the term 'diameter' denotes the maximum dimension in the transverse direction of the combustible heat source, aerosol generating article, end piece or other apparatus or component. As used herein, the terms 'radial' and 'transverse' are used to describe the direction perpendicular to the longitudinal direction. In use, the cage at least partially surrounds the heat source. Preferably, the cage surrounds the heat source along the length of the heat source. The distance between the cage and the heat source, the material of the cage, the thickness of the cage, and the permeability of the cage, among other factors, may be selected to control the maximum temperature, relative to the heat source when in use. Preferably, the cage reaches a maximum temperature substantially lower than the heat source when the heat source is combusted and is disposed within the cage. For example, a temperature at an exposed surface of the cage may be at least 200° C. less than the temperature of a surface of the heat source. Preferably, a temperature at an exposed surface of the cage may be at least 300° C. less than the temperature of a surface of the heat source. For example, when the heat source temperature is about 400° C., preferably the exposed surface of the retainer is less than about 200° C., preferably less than about 150° C.

The cage may be separated from the heat source by any suitable distance. For example, the radial clearance between the heat source and the cage may be between about 0.2 mm and about 3 mm. Preferably, the radial clearance between the heat source and the cage is between about 0.5 mm and about 1 mm, for example between about 1 mm and about 2 mm.

The cage may be made of any suitable material or combination of materials. Preferably, the material or materials forming the cage are heat resistant. For example, the cage may be formed from materials that can withstand temperatures of about 200° C. or greater. The cage may be formed from a polymer, or a material comprising a metal, such as aluminium or stainless steel, or a ceramic material. In addition or alternatively, the body may for example be formed of wood or a carbon fibre or glass fibre material. Examples of suitable polymer materials that may be used to form the body include polyetheretherketone (PEEK).

Preferably the material or materials from which the cage is made are sufficiently thermally conductive, sufficiently thin, or are of a sufficiently low density to rapidly dissipate heat.

The cage, or one or more portions of the cage, preferably has sufficient permeability to allow air to access the heat source through the cage to maintain combustion of the heat source. The term "permeability" refers to a percent of total area of a surface or a portion of a surface that is void space area. Preferably at least a portion of the cage that surrounds the heat source has sufficient permeability to allow a lighting of the heat source by a flame, preferably through the cage. Preferably, the cage comprises a distal face defining an opening that has a cross sectional area that is between 80% and 100% of a cross sectional area of the bore of the cage. In addition or alternatively, the cage comprises openings, such as through-holes, disposed radially about the heat source. In preferred embodiments, the cage comprises a generally tubular wall with ventilation openings through the wall. In some preferred embodiments, the permeability of the portion of the cage surrounding the heat source is sufficient to maintain combustion of the heat source only when the ventilation openings or through holes are not covered. Accordingly, the openings may be covered to extinguish the heat source.

The cage may comprise a cover to aid in extinguishing the heat source. For example, the cover may comprise a sleeve that is movable from a first position to a second position. In the first position the sleeve does not cover the openings of the cage. In the second position the sleeve covers the openings and may aid in extinguishing the heat source. By way of another example, the cover may comprise a ring element disposed about a body of the cage and rotatable about a longitudinal axis of the cage. The ring may comprise through-holes that align with openings through the body of the cage when appropriately rotated. Rotation of the ring about the cage away from the aligned position may completely or partially block the openings through the body of the cage to aid in extinguishing the heat source.

Preferably, the cage comprises ventilation through-holes downstream of the portion surrounding the heat source. Preferably such holes allow cool air to be drawn through the aerosol generating article. In preferred embodiments, the cage comprises a non-permeable wall between the distal end of the cage and the downstream ventilation openings. Such wall may reduce the amount or number of combustion products from the heat source from entering the air drawn into the aerosol generating article.

An end piece according to present invention preferably comprises a seal that extends from the inner surface of the cage into the bore of the cage. The seal is arranged to surround and contact the aerosol generating article, preferably downstream of the heat source. The seal may prevent or limit combustion products released from the heat source from entering air drawn through the aerosol generating article. The seal is preferably positioned upstream of the downstream ventilation openings of the cage.

The seal may have any suitable inner diameter. Preferably, the inner diameter of the seal, in a relaxed state, is less than the outer diameter of the aerosol generating article. As an aerosol generating article is introduced into an end piece according to the present invention, the seal may deflect to allow passage of the article through the seal. The seal may serve to hold the cage in a longitudinal position relative to the aerosol generating article when the article is fully inserted into the end piece.

The seal may be integrally formed with the cage or attached to the cage in any suitable manner. The seal may be formed of any suitable material or combination of materials. Because the seal is configured to be placed in proximity to the heat source, the seal preferably comprises heat resistant materials. The seal preferably comprises a resilient material. The seal may comprise an o-ring. Examples of materials that may be used to form a seal or a portion thereof include plastic materials and elastomers, for example nitrile or fluorocarbons (viton) materials.

An end piece according to the present invention includes a distal stop. The stop is arranged to engage a distal end of the heat source as the aerosol generating article is introduced into the end piece. The distal stop is configured to prevent the distal end of the heat source from being advanced beyond the cage. Preferably, the distal stop is configured and positioned to prevent the aerosol generating article to be inserted in the end piece in an opposite, unintended direction. The distal stop may be positioned at a distal end of the cage and may extend towards the longitudinal axis of the bore of the cage. Preferably, the distal stop extends towards the longitudinal axis of the bore a distance less than the radius of the bore. The distal stop may be attached to the cage. Preferably, the distal stop is integrally formed with the cage. Preferably, the distal stop is formed from one or more materials that are heat resistant. For example, the stop may be formed from one or more heat resistant materials described above regarding the cage. Preferably, the stop is formed from a metal material such as stainless steel or aluminum or a glass or ceramic material.

An end piece according to the present invention is configured in examples to allow an aerosol generating article to be inserted, heat source first, into a bore defined by the body until the heat source engages the distal stop and no further distal movement of the article in the cage occurs. If the cage is slidable over the body, after the heat source engages the stop, the cage may be distally advanced over the body by further distal advancement of the aerosol generating article until the cage engages the body and further advancement is prevented. Distal movement of the article may occur until, for example, a proximal stop of the cage engages a distal flange of the body. Openings at the distal portion of the cage allow for lighting of the heat source, continued combustion of the heat source, and evacuation of combustion gasses when the aerosol generating article is fully inserted into the end piece. Openings in the cage permit outside air to be drawn into the aerosol generating article, through a heated aerosol generating substrate and into a user's mouth. Preferably, the openings that permit outside air to be drawn through the aerosol generating article are separated from more distal cage openings by a seal. If the cage comprises a cover, the cover may be moved to cover distal openings in the cage to aid in extinguishing the heat source.

The cage may include a flexible portion that permits a user to depress the flexible portion to pinch off the heat source, for example when the user has finished using the aerosol generating article.

End pieces according to the present invention may be used with any suitable aerosol generating article having a combustible heat source. The aerosol generating article includes an aerosol generating substrate that may be heated by the combustible heat source to release one or more volatile compounds from the aerosol generating substrate.

An aerosol generating article for use with an end piece according to the present invention may include any suitable combustible heat source.

The combustible heat source is preferably a blind combustible heat source. As used herein, the term 'blind' describes a heat source that does not comprise any air flow channels that provide inhalation air to the aerosol-generating substrate. In a blind combustible heat source, heat transfer from the blind combustible heat source to the aerosol generating substrate occurs primarily by conduction and heating of the aerosol generating substrate by forced convection is minimized or reduced. The lack of any airflow channels through the blind combustible heat source advantageously substantially prevents or inhibits activation of combustion of the blind combustible heat source during puffing by a user. This substantially prevents or inhibits spikes in the temperature of the aerosol generating substrate during puffing by a user. By preventing or inhibiting activation of combustion of the blind combustible heat source, and so preventing or inhibiting excess temperature increases in the aerosol generating substrate, combustion or pyrolysis of the aerosol generating substrate under intense puffing regimes may be advantageously avoided. In addition, the impact of a user's puffing regime on the composition of the mainstream aerosol may be advantageously minimized or reduced. The inclusion of a blind combustible heat source may also advantageously substantially prevent or inhibit combustion and decomposition products and other materials formed during ignition and combustion of the blind combustible heat source from entering air drawn through the aerosol generating article during use thereof.

Alternatively, the combustible heat source comprises at least one longitudinal airflow channel, which provides one or more inhalation airflow pathways through the heat source to the aerosol generating substrate. This inhalation airflow channel may extend along the length of the heat source through which air may be drawn through the aerosol generating article for inhalation by a user. Such heat sources including one or more longitudinal inhalation airflow channels are referred to herein as "non-blind" heat sources.

The combustible heat source is preferably a carbonaceous heat source having a carbon content of at least about 35 percent, more preferably of at least about 40 percent, most preferably of at least about 45 percent by dry weight of the combustible heat source. Where the combustible heat source is a carbonaceous heat source, the combustible heat source may be formed from one or more suitable carbon-containing materials. The term "carbonaceous" refers to a material that comprises carbon.

The combustible heat source may be a combustible carbon-based heat source having a carbon content of at least about 50 percent. For example, the combustible heat source may be a combustible carbon-based heat source having a carbon content of at least about 60 percent, or at least about 70 percent, or at least about 80 percent by dry weight of the combustible heat source. The term "carbon-based" refers to a material comprises primarily of carbon or at least about 50% carbon, by dry weight of material.

One or more binders may be combined with the one or more carbon-containing materials to form the carbonaceous heat source. The combustible heat source may comprise one or more organic binders, one or more inorganic binders or a combination of one or more organic binders and one or more inorganic binders.

Instead of, or in addition to one or more binders, the combustible heat source may comprise one or more additives in order to improve the properties of the combustible heat source. Suitable additives include, but are not limited to, additives to promote consolidation of the combustible heat source (for example, sintering aids), additives to promote ignition of the combustible heat source (for example, oxidisers such as perchlorates, chlorates, nitrates, peroxides, permanganates, zirconium and combinations thereof), additives to promote combustion of the combustible heat source (for example, potassium and potassium salts, such as potassium citrate) and additives to promote decomposition of one or more gases produced by combustion of the combustible heat source (for example catalysts, such as CuO, $Fe_2O_3$ and $Al_2O_3$). Combustible heat sources for aerosol generating articles and methods for producing such heat sources are known in the art and described in, for example, U.S. Pat. Nos. 5,040,552 and 5,595,577.

Preferably, the combustible heat source has an apparent density of between about 0.8 g/cm$^3$ and about 1.1 g/cm$^3$. Preferably, the combustible heat source has a mass of between about 300 mg and about 500 mg, more preferably of between about 400 mg and about 450 mg. Preferably, the combustible heat source has a length of between about 7 mm and about 17 mm, more preferably of between about 7 mm and about 15 mm, most preferably of between about 7 mm and about 13 mm. Preferably, combustible heat sources according to the invention have a diameter of between about 5 mm and about 9 mm, more preferably of between about 7 mm and about 8 mm.

Preferably, the combustible heat source is of substantially uniform diameter. However, the combustible heat source may alternatively be tapered such that the diameter of one of the front end face and the rear end face of the combustible heat source is greater than the diameter of the other of the front end face and the rear end face thereof. For example, combustible heat sources may be tapered such that the diameter of the rear end face of the combustible heat source is greater that the diameter of the front end face of the combustible heat source. Preferably, the combustible heat source is substantially cylindrical. The combustible heat source may be a cylindrical combustible heat source of substantially circular cross-section or of substantially elliptical cross-section. In particularly preferred embodiments, the combustible heat source is a substantially cylindrical combustible heat source of substantially circular cross-section.

An aerosol generating article for use with an end piece according to the invention may include any aerosol generating substrate.

Preferably, the aerosol generating substrate comprises at least one aerosol-former and a material capable of releasing volatile compounds in response to heating. The aerosol generating substrate may comprise other additives and ingredients including, but not limited to, humectants, flavorants, binders and mixtures thereof. Preferably, the aerosol generating substrate comprises nicotine. More preferably, the aerosol generating substrate comprises tobacco.

The at least one aerosol-former may be any suitable known compound or mixture of compounds that, in use, facilitates formation of a dense and stable aerosol and that is substantially resistant to thermal degradation at the operating temperature of the aerosol generating article. Suitable aerosol-formers are well known in the art and include, for example, polyhydric alcohols, esters of polyhydric alcohols, such as glycerol mono-, di- or triacetate, and aliphatic esters of mono-, di- or polycarboxylic acids, such as dimethyl dodecanedioate and dimethyl tetradecanedioate. Preferred aerosol formers for use in aerosol generating articles herein are polyhydric alcohols or mixtures thereof, such as triethylene glycol, 1,3-butanediol and, most preferred, glycerin.

The material capable of emitting volatile compounds in response to heating may be a charge of plant-based material. The material capable of emitting volatile compounds in response to heating may be a charge of homogenized plant-based material. For example, the aerosol generating substrate may comprise one or more materials derived from plants including, but not limited to: tobacco; tea, for example green tea; peppermint; laurel; eucalyptus; basil; sage; verbena; and tarragon. Preferably, the material capable of emitting volatile compounds in response to heating is a charge of tobacco-based material, most preferably a charge of homogenised tobacco-based material.

The aerosol generating substrate may be in the form of a plug or segment comprising a material capable of emitting volatile compounds in response to heating circumscribed by a paper or other wrapper. As stated above, where an aerosol generating substrate is in the form of such a plug or segment, the entire plug or segment including any wrapper is considered to be the aerosol generating substrate. The aerosol generating substrate preferably has a length of between about 5 mm and about 20 mm. Preferably, the aerosol generating substrate has a length of between about 6 mm and about 15 mm or a length of between about 7 mm and about 12 mm. In preferred embodiments, the aerosol generating substrate comprises a plug of tobacco-based material wrapped in a plug wrap. In particularly preferred embodiments, the aerosol generating substrate comprises a plug of homogenised tobacco-based material wrapped in a plug wrap.

End pieces according to the present invention may be used with any suitable aerosol generating article.

Aerosol generating articles for use with end pieces according to the present invention may comprise one or more air inlets around the periphery of the aerosol generating substrate. In such embodiments, in use, cool air is drawn into the aerosol generating substrate of the aerosol generating article through the air inlets. The air drawn into the aerosol generating substrate through the air inlets passes downstream through the aerosol generating article from the aerosol generating substrate and exits the aerosol generating article through the mouthpiece or proximal end thereof.

In such embodiments, during puffing by a user the cool air drawn through the one or more air inlets around the periphery of the aerosol generating substrate advantageously reduces the temperature of the aerosol generating substrate. This advantageously substantially prevents or inhibits spikes in the temperature of the aerosol generating substrate during puffing by a user. As used herein, the term 'cool air' is used to describe ambient air that is not significantly heated by the combustible heat source upon puffing by a user.

Aerosol generating articles described herein may comprise a heat conducting element around and in direct contact with both at least a rear portion of the heat source and at least a front portion of the aerosol generating substrate. The heat conducting element provides a thermal link between the combustible heat source and the aerosol generating substrate and advantageously helps to facilitate adequate heat transfer from the combustible heat source to the aerosol generating substrate to provide an acceptable aerosol.

Suitable heat conducting elements for use herein include, but are not limited to: metal foil wrappers such as, for example, aluminum foil wrappers, steel wrappers, iron foil wrappers and copper foil wrappers; and metal alloy foil wrappers.

Aerosol generating articles described herein preferably comprise a mouthpiece located at the proximal end thereof. Preferably, the mouthpiece is of low filtration efficiency, more preferably of very low filtration efficiency. The mouthpiece may be a single segment or component mouthpiece. Alternatively, the mouthpiece may be a multi-segment or multi-component mouthpiece.

The mouthpiece may comprise a filter comprising one or more segments comprising suitable known filtration materials. Suitable filtration materials are known in the art and include, but are not limited to, cellulose acetate and paper. Alternatively or in addition, the mouthpiece may comprise one or more segments comprising absorbents, adsorbents, flavorants, and other aerosol modifiers and additives or combinations thereof.

Aerosol generating articles described herein preferably further comprise a transfer element or spacer element between the aerosol generating substrate and the mouthpiece. The transfer element may abut one or both of the aerosol generating substrate and the mouthpiece. Alternatively, the transfer element may be spaced apart from one or both of the aerosol generating substrate and the mouthpiece.

The inclusion of a transfer element advantageously allows cooling of the aerosol generated by heat transfer from the combustible heat source to the aerosol generating substrate. The inclusion of a transfer element also advantageously allows the overall length of the aerosol generating article to be adjusted to a desired value, for example to a length similar to that of a conventional cigarette, through an appropriate choice of the length of the transfer element.

The transfer element may have a length of between about 7 mm and about 50 mm, for example a length of between about 10 mm and about 45 mm or of between about 15 mm and about 30 mm. The transfer element may have other lengths depending upon the desired overall length of the aerosol generating article, and the presence and length of other components within the aerosol generating article.

Preferably, the transfer element comprises at least one open-ended tubular hollow body. In such embodiments, in use, air drawn into the aerosol generating article passes through the at least one open-ended tubular hollow body as it passes downstream through the aerosol generating article from the aerosol generating substrate to the mouthpiece. The transfer element may comprise at least one open-ended tubular hollow body formed from one or more suitable materials that are substantially thermally stable at the temperature of the aerosol generated by the transfer of heat from the combustible heat source to the aerosol generating substrate. Suitable materials are known in the art and include, but are not limited to, paper, cardboard, plastics, such a cellulose acetate, ceramics and combinations thereof.

Alternatively or in addition, aerosol generating articles described herein may comprise an aerosol cooling element or heat exchanger between the aerosol generating substrate and the mouthpiece. The aerosol cooling element may comprise a plurality of longitudinally extending channels. The aerosol cooling element may comprise a gathered sheet of material selected from the group consisting of metallic foil, polymeric material, and substantially non-porous paper or cardboard. In certain embodiments, the aerosol-cooling element may comprise a gathered sheet of material selected from the group consisting of polyethylene (PE), polypropylene (PP), polyvinylchloride (PVC), polyethylene terephthalate (PET), polylactic acid (PLA), cellulose acetate (CA), and aluminum foil. Preferably the aerosol-cooling element may comprise a gathered sheet of biodegradable polymeric material, such as polylactic acid (PLA) or a grade of Mater-Bi® (a commercially available family of starch based copolyesters).

The aerosol generating articles described herein comprise an outer wrapper that circumscribes the aerosol generating substrate and at least a rear portion of the heat source or heat source holder. The outer wrapper should grip the heat source and heat source holder and the aerosol generating substrate of the aerosol generating article when the aerosol generating article is assembled. Preferably the outer wrapper circumscribes the aerosol generating substrate, at least a rear portion of the heat source and heat source holder and any other components of the aerosol generating article downstream of the aerosol generating substrate. Outer wrappers may be formed from any suitable material or combination of materials. Suitable materials are well known in the art and include, but are not limited to, cigarette paper. Alternatively or in addition, the mouthpiece may be circumscribed by tipping paper. Aerosol generating articles described herein may be assembled using known methods and machinery.

The aerosol generating article may be substantially cylindrical in shape. The aerosol generating article may be substantially elongate. The aerosol generating article has a length and a circumference substantially perpendicular to the length. The aerosol generating substrate may be substantially cylindrical in shape. The aerosol-generating substrate may be substantially elongate. The aerosol generating substrate also has a length and a circumference substantially perpendicular to the length. The aerosol generating substrate may be located in the aerosol generating or such that the length of the aerosol generating substrate is substantially parallel to the airflow direction in the aerosol generating article. The transfer section or element may be substantially elongate.

The aerosol generating article may have any desired length. For example, the aerosol generating article may have a total length of between approximately 65 mm and approximately 100 mm. The aerosol generating article may have any desired external diameter. For example, the aerosol generating article may have an external diameter of between approximately 5 mm and approximately 12 mm.

All scientific and technical terms used herein have meanings commonly used in the art unless otherwise specified. The definitions provided herein are to facilitate understanding of certain terms used frequently herein.

As used herein, the singular forms "a", "an", and "the" encompass embodiments having plural referents, unless the content clearly dictates otherwise.

As used herein, "or" is generally employed in its sense including "and/or" unless the content clearly dictates otherwise. The term "and/or" means one or all of the listed elements or a combination of any two or more of the listed elements.

As used herein, "have", "having", "include", "including", "comprise", "comprising" or the like are used in their open ended sense, and generally mean "including, but not limited to". It will be understood that "consisting essentially of", "consisting of", and the like are subsumed in "comprising," and the like.

The words "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the disclosure, including the claims.

Reference will now be made to the drawings, which depict one or more aspects described in this disclosure. However, it will be understood that other aspects not depicted in the drawing fall within the scope and spirit of this disclosure. Like numbers used in the figures refer to like components, steps and the like. However, it will be understood that the use of a number to refer to a component in a given figure is not intended to limit the component in another figure labeled with the same number. In addition, the use of different numbers to refer to components in different figures is not intended to indicate that the different numbered components cannot be the same or similar to other numbered components.

The schematic drawings are not necessarily to scale and are presented for purposes of illustration and not limitation.

Figure 1:
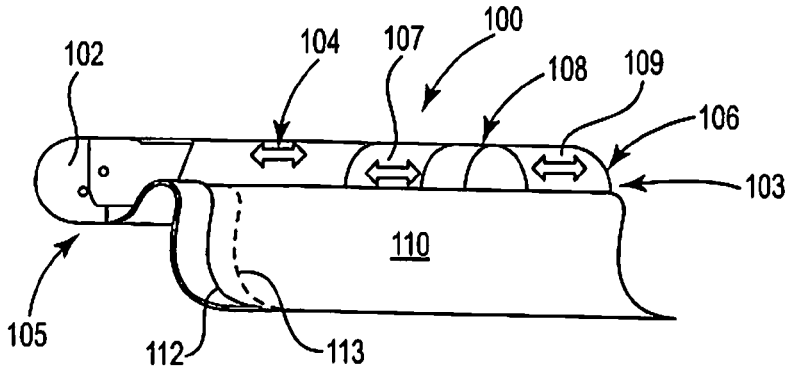
FIG. 1 is schematic perspective view of an illustrative aerosol generating article 100 with the wrapper 110 partially opened to view the internal contents.

Referring now to FIG. 1, an aerosol generating article 100 extends between a proximal end 103 and a distal end 105. The aerosol generating article 100 includes a combustible heat source 102 positioned at the distal end 105 of the aerosol generating article 100, an aerosol generating substrate 104 downstream of the combustible heat source 102 and a mouthpiece 106 downstream of the aerosol generating substrate 104 and positioned at the proximal end 103 of the aerosol generating article 100.

The aerosol generating article 100 comprises a combustible heat source 102, an aerosol generating substrate 104, an aerosol cooling element 107, an elongate expansion chamber or transfer element 108 and a mouthpiece 106, are in sequential, abutting coaxial alignment, which are overwrapped in an outer wrapper 110 of, for example, cigarette paper. The combustible heat source 102 is cylindrical.

The aerosol generating substrate 104 is located immediately downstream of the combustible heat source 102 and comprises a cylindrical plug of homogenized tobacco material comprising, for example, glycerin as aerosol former and circumscribed by filter plug wrap. A heat conducting element 112, consisting of a tube of aluminum foil, surrounds and is in contact with a rear portion of the combustible heat source 102 and an abutting front portion of the aerosol generating substrate 104. The elongate expansion chamber 108 is located downstream of the aerosol generating substrate 104 and comprises a cylindrical open-ended tube of cardboard. The mouthpiece 106 is located downstream of the expansion chamber 108 and comprises a cylindrical plug of cellulose acetate tow 109 circumscribed by filter plug wrap.

In use, the user ignites the combustible heat source which heats the aerosol generating substrate to produce an aerosol. When the user inhales on the mouthpiece 106 air is drawn through the aerosol generating substrate 104 through air inlet holes 113 in the cigarette paper 110 and adjacent to the aerosol generating substrate 104, through the expansion chamber 108, through the mouthpiece 106 and into the user's mouth.

Figure 2:
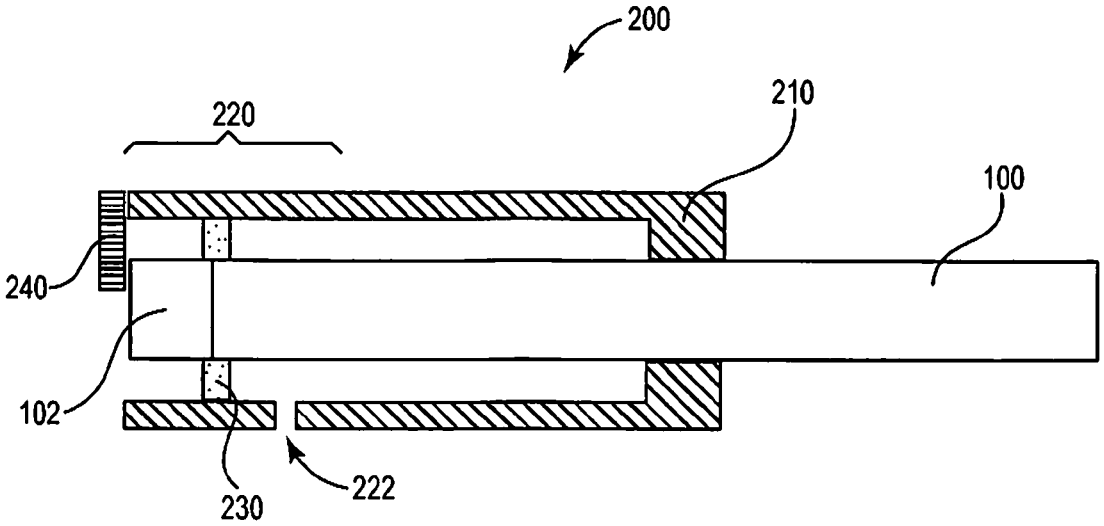
FIG. 2 is a schematic sectional view of an illustrative aerosol generating article 100 disposed in an illustrative end piece 200.

Referring now to FIG. 2, an aerosol generating article 100 is disposed in an end piece 200. The end piece 200 includes a body 210, a cage 220, a seal 230, and a stop 240. The body 210 defines a bore in which the aerosol generating article 100 is slidably received. In FIG. 2, the cage 220 is an extension of the body 210. The cage 210 surrounds a portion of the heat source 102 of the aerosol generating article 100. Air may access the heat source through the proximal face and due to the clearance between the cage 220 and the heat source 102. A portion of the cage 220 distal to the seal 230 may include openings (not shown) extending through the wall of the cage for additional ventilation. A proximal portion of the cage 220 includes one or more ventilation holes 222 through the wall of the cage to allow cool air to be drawn in downstream of the seal 230. The seal 230 extends from an inner surface of the cage 220 downstream of the stop 240. The seal is arranged to surround and contact the aerosol generating article 100 downstream of the heat source 102. The stop 240 is arranged to engage the distal end of the heat source 102 as the aerosol generating article 100 is slid through the bore of the body 210 and is configured to prevent the distal end of the heat source 102 from being advanced beyond the cage 220. The stop 220 is positioned at the distal end portion of the cage 220 and extends a sufficient distance towards the longitudinal axis of the cage to engage the heat source 102 as the aerosol generating article is advanced through the end piece 200. The stop 240 may be coupled to, or integrally formed with, the cage 220.

Figure 3:
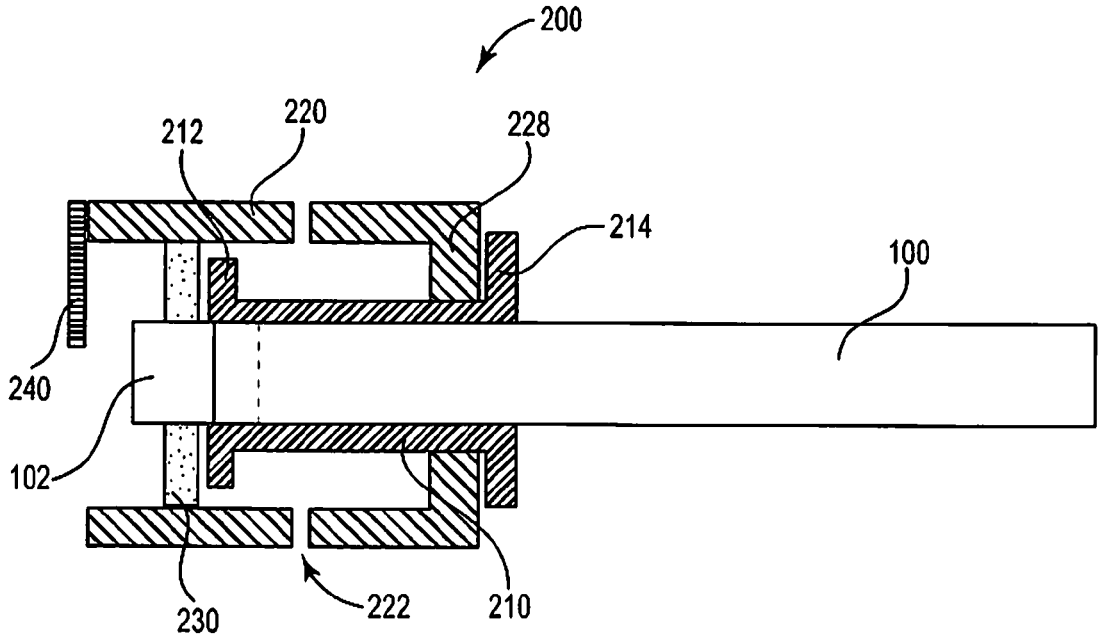
FIG. 3 is a schematic sectional view of an illustrative aerosol generating article 100 partially received by an illustrative end piece 200.
Figure 4:
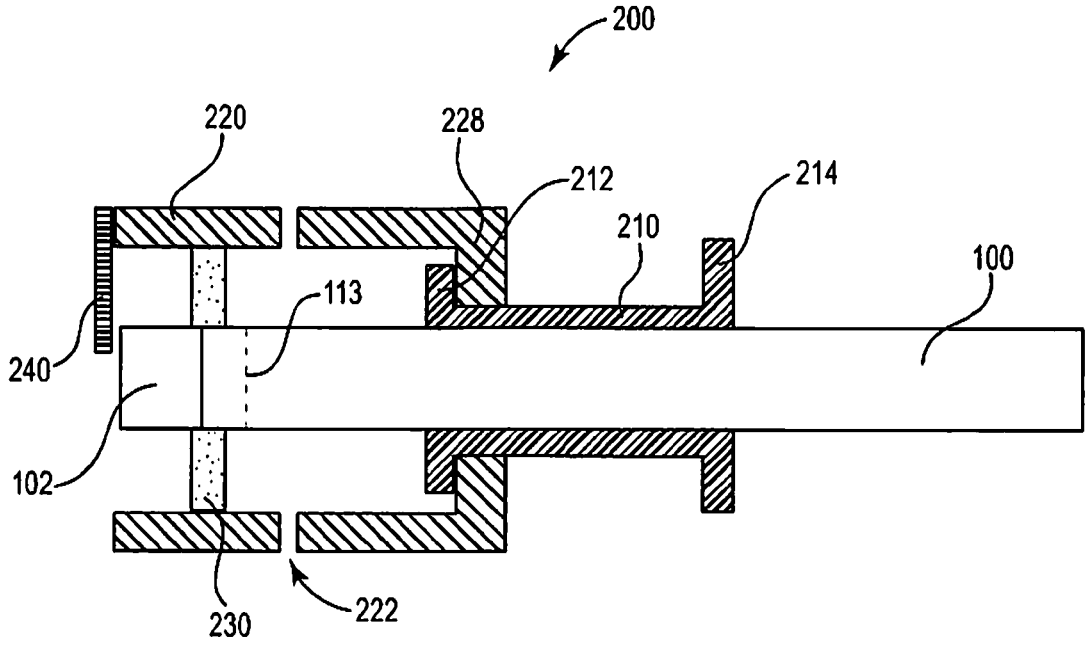
FIG. 4 is a schematic sectional view of an illustrative aerosol generating article 100 fully received by an illustrative end piece 200.

Referring now to FIGS. 3-4, an aerosol generating article 100 is shown partially inserted into an end piece (FIG. 3) and fully inserted into an end piece (FIG. 4). The depicted cage 220 is slidably disposed about the body 210. The depicted body 210 has a distal flange 212 and a proximal flange 214, and the cage has a proximal stop 228 configured to interact with the proximal 214 and distal 212 flanges of the body 210 to prevent the cage 220 from sliding off of the body 210. As the aerosol generating article 100 is slid into and advanced through the bore defined by the body 210, the heat source 102 engages distal stop 240 and causes the cage 220 to slide distally over the body 210 until the proximal stop 228 engages the distal flange 212. As with the end piece depicted in FIG. 2, the end piece depicted in FIGS. 3-4 also includes a seal 230 that extends from an inner surface of the cage 220 and sealingly engages the aerosol generating article 100 downstream of the heat source 102. The cage 220 depicted in FIGS. 3-4 include one or more ventilation holes 222 to allow cool air to be drawn in downstream of the seal 230. The cool air may be drawn through air inlet holes 113, through the aerosol generating substrate (not shown), through the aerosol generating article 110, and into a users mouth.

Figure 5:
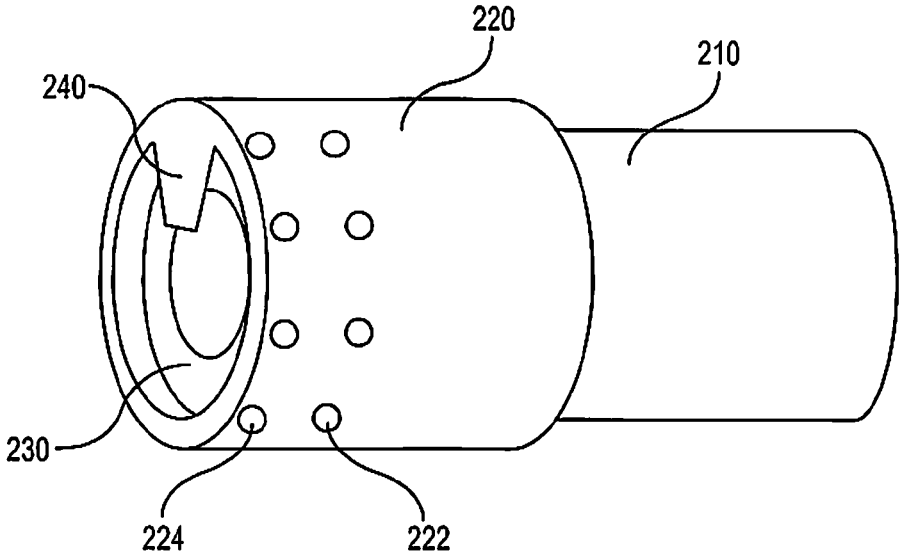
FIG. 5 is a schematic perspective view of an illustrative end piece 200.

Referring now to FIG. 5 a schematic perspective view of an illustrative end piece 200 is shown. The end piece 200 includes a cage 220 slidable about a body 210 that has a bore (not shown) configured to slidably receive an aerosol generating article. A seal 230 extends from an inner surface of the cage 220 and is configured and arranged to sealing engage the aerosol generating article downstream of a heat source. The end piece includes a stop 240 configured and arranged to prevent the heat source from extending beyond the distal end of the cage 220. The cage 220 comprises a plurality of ventilation holes 222 downstream of the seal 230 and a plurality of ventilation holes upstream of the seal 230.

Thus, methods, systems, apparatuses, assemblies and articles for an end piece for aerosol generating articles are described. Various modifications and variations of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention which are apparent to those skilled in the mechanical arts and aerosol generating article manufacturing or related fields are intended to be within the scope of the following claims.

The invention claimed is:

1. An end piece for positioning over a heat source of an aerosol generating article, the end piece comprising:

a body defining a bore configured to receive the aerosol generating article;

a cage configured to surround at least a portion of the heat source and to allow air to access the heat source, the cage comprising a wall and one or more openings through the wall;

a stop arranged to engage a distal end of the heat source as the aerosol generating article is slid through the bore, wherein the stop is configured to prevent the distal end of the heat source from being advanced beyond the cage; and a seal extending from an inner surface of the cage downstream of the stop and upstream of the one or more openings through the cage wall, wherein the seal is arranged to surround and contact the aerosol generating article and is configured to prevent or limit combustion products released from the heat source from entering air drawn through the aerosol generating article, wherein the end piece is configured such that air drawn through the one or more holes through the wall flows through aerosol generating substrate of the aerosol generating article, wherein the stop is configured to prevent a proximal end of the aerosol generating article from being received in the bore such that the proximal end of the aerosol generating article extends proximally from the body, and wherein the aerosol generating article has a length from 65 mm to 100 mm.

2. The end piece according to claim 1, wherein the cage defines a bore having a longitudinal axis and an inner diameter greater than an outer diameter of the heat source, and wherein at least a portion of the stop is positioned a distance from the longitudinal axis of the bore less than a radius of the bore.

3. The end piece according to claim 1, wherein the stop is coupled to a distal end of the cage.

4. The end piece according to claim 1, wherein the stop is integrally formed with at least a portion the cage.

5. The end piece according to claim 4, wherein the wall of the cage further defines one or more upstream holes through the wall, wherein the upstream holes are upstream of the seal.

6. The end piece according to claim 1, wherein the seal is positioned to engage the aerosol generating article downstream of the heat source when the distal end of the heat source is engaged with the stop.

7. The end piece according to claim 1, wherein the cage is slidably disposed about the body.

8. The end piece according to claim 7, wherein the body comprises a flange and the cage comprises a proximal stop configured to engage the flange as the cage is distally advanced over the body.

9. The end piece according to claim 1, wherein the body is configured to engage the aerosol generating article via an interference fit.

10. An assembly comprising the end piece according to claim 1 and the aerosol generating article having the heat source, wherein the aerosol generating article is received in the end piece.

11. The assembly comprising the end piece according to claim 1 and the aerosol generating article having the heat source, wherein the aerosol generating article is received in the end piece, wherein the aerosol generating article comprises an aerosol generating substrate, and wherein the one or more holes downstream of the seal are positioned adjacent the aerosol generating substrate.

12. A kit comprising the end piece according to claim 1 and one or more aerosol generating articles having a heat source, wherein the aerosol generating articles are configured to be received by the end piece.

13. The kit according to claim 12, wherein the aerosol generating article comprises an aerosol generating substrate and wherein the aerosol generating article is configured to transfer heat from the heat source to the aerosol generating substrate without combusting the aerosol generating substrate.

14. The kit according to claim 13, wherein the aerosol generating substrate comprises tobacco.

15. The assembly according to claim 10, wherein the aerosol generating article comprises an aerosol generating substrate and wherein the aerosol generating article is configured to transfer heat from the heat source to the aerosol generating substrate without combusting the aerosol generating substrate.

16. The assembly according to claim 15, wherein the aerosol generating substrate comprises tobacco.

17. The assembly according to claim 16, wherein the aerosol generating article is configured such that the heat source heats the aerosol generating substrate primarily by conduction.

18. The kit according to claim 14, wherein the aerosol generating article is configured such that the heat source heats the aerosol generating substrate primarily by conduction.

19. The end piece according to claim 1, wherein the end piece has a maximum length less than a length of the aerosol generating article.

20. An end piece for positioning over a heat source of an aerosol generating article, the end piece comprising:

a body defining a bore configured to receive the aerosol generating article;

a cage configured to surround at least a portion of the heat source and to allow air to access the heat source, the cage comprising a wall and one or more openings through the wall;

a stop arranged to engage a distal end of the heat source as the aerosol generating article is slid through the bore, wherein the stop is configured to prevent the distal end of the heat source from being advanced beyond the cage, wherein the stop is configured to prevent a proximal end of the aerosol generating article from being received in the bore such that the proximal end of the aerosol generating article extends proximally from the body; and a seal extending from an inner surface of the cage downstream of the stop and upstream of the one or more openings through the cage wall, wherein the seal is arranged to surround and contact the aerosol generating article and is configured to prevent or limit combustion products released from the heat source from entering air drawn through the aerosol generating article, wherein the end piece is configured such that air drawn through the one or more holes through the wall flows through aerosol generating substrate of the aerosol generating, wherein the end piece has a maximum length less than a length of the aerosol generating article.

21. The end piece according to claim 1, wherein the seal is configured to sealingly engage the aerosol generating article downstream of the heat source.

22. An end piece for positioning over a heat source of an aerosol generating article, the end piece comprising:

a body defining a bore configured to receive the aerosol generating article;

a cage configured to surround at least a portion of the heat source and to allow air to access the heat source, the cage comprising a wall and one or more openings through the wall;

a stop arranged to engage a distal end of the heat source as the aerosol generating article is slid through the bore, wherein the stop is configured to prevent the distal end of the heat source from being advanced beyond the cage; and a seal extending from an inner surface of the cage downstream of the stop and upstream of the one or more openings through the cage wall, wherein the seal is arranged to surround and contact the aerosol generating article and is configured to prevent or limit combustion products released from the heat source from entering air drawn through the aerosol generating article, wherein the seal is deflectable to allow passage of the aerosol generating article through the seal, and wherein the end piece is configured such that air drawn through the one or more holes through the wall flows through aerosol generating substrate of the aerosol generating article.

* * * * *